US012746458B2

(12) United States Patent
Kushner

(10) Patent No.: US 12,746,458 B2
(45) Date of Patent: Sep. 29, 2026

(54) GAME SYSTEM AND PIECES

(71) Applicant: UT Brands LLC, San Diego, CA (US)

(72) Inventor: Robert Kushner, San Diego, CA (US)

(73) Assignee: UT BRANDS LLC, San Diego, CA (US)

( * ) Notice: Subject to any disclaimer, the term of this patent is extended or adjusted under 35 U.S.C. 154(b) by 0 days.

(21) Appl. No.: 19/452,120

(22) Filed: Jan. 16, 2026

(65) Prior Publication Data

US 2026/0257128 A1 Sep. 3, 2026

Related U.S. Application Data

(60) Provisional application No. 63/766,151, filed on Mar. 3, 2025.

(51) Int. Cl.

| | |
|---|---|
| ***A63F 9/26*** | (2006.01) |
| ***A63F 7/00*** | (2006.01) |
| ***A63F 7/30*** | (2006.01) |

(52) U.S. Cl.

CPC ..... *A63F 9/26* (2013.01); *A63F 7/0023* (2013.01); *A63F 7/30* (2013.01)

(58) Field of Classification Search

CPC .. A63F 9/26; A63F 7/0023; A63F 7/30; A63F 7/04

See application file for complete search history.

(56) References Cited

U.S. PATENT DOCUMENTS

| | | | | | |
|---|---|---|---|---|---|
| 2,458,306 | A * | 1/1949 | Schneider | A63H 15/04 | 473/418 |
| 3,675,920 | A * | 7/1972 | Gorman | A63F 3/00 | 273/459 |
| 3,700,234 | A * | 10/1972 | Philippi | A63F 9/26 | 273/456 |
| 4,512,578 | A * | 4/1985 | Dalton | A63F 7/38 | 273/110 |
| 4,579,346 | A * | 4/1986 | Giuntoli | A63F 9/26 | 273/449 |
| 4,744,563 | A * | 5/1988 | Anastasia | A63F 7/38 | 273/DIG. 19 |
| 5,314,181 | A * | 5/1994 | Lin | A63F 9/0078 | 273/153 R |
| 6,318,726 | B1 * | 11/2001 | Nicholls | A63F 9/26 | 273/449 |
| 2009/0200743 | A1 * | 8/2009 | Gray | A63F 9/26 | 273/450 |

(Continued)

FOREIGN PATENT DOCUMENTS

| | | | | |
|---|---|---|---|---|
| DE | 2133338 A1 * | 2/1973 | | |
| DE | 202005001963 U1 * | 5/2005 | | A63F 9/26 |

(Continued)

*Primary Examiner* — Raleigh W Chiu

(74) *Attorney, Agent, or Firm* — Umberg Zipser LLP

(57) ABSTRACT

A balancing game system and method of play are disclosed, comprising a plurality of spheres or other game pieces and a base configured to have tilting instability. The base features a planar top surface with a plurality of indentations sized to receive and cradle the spheres, along with a hemispherical bottom surface that enables multi-directional tilting in response to off-center weight distribution caused by the sphere placement on the planar top surface.

14 Claims, 7 Drawing Sheets

(56) References Cited

U.S. PATENT DOCUMENTS

| | | | | |
|---|---|---|---|---|
| 2010/0276881 | A1* | 11/2010 | Tu | A63F 9/26 273/241 |
| 2010/0314832 | A1* | 12/2010 | Cornish | A63F 9/26 273/236 |
| 2014/0110902 | A1* | 4/2014 | Thompson | A63F 9/26 273/450 |
| 2014/0312569 | A1* | 10/2014 | Berendt | A63F 9/26 273/449 |
| 2023/0082537 | A1* | 3/2023 | Christou | A63F 9/26 273/449 |

FOREIGN PATENT DOCUMENTS

| | | | | |
|---|---|---|---|---|
| DE | 102010053046 | A1 * | 6/2012 | A63F 9/26 |
| DE | 202015002376 | U1 * | 5/2015 | A63F 9/26 |
| DE | 202025105654 | U1 * | 11/2025 | A63F 7/0023 |
| FR | 2655272 | A1 * | 6/1991 | A63F 9/00 |
| GB | 1361584 | A * | 7/1974 | A63F 9/26 |
| KR | 100879052 | B1 * | 1/2009 | A61F 5/01 |
| KR | 20190087093 | A * | 7/2019 | A63F 9/26 |
| WO | WO-03026755 | A1 * | 4/2003 | A63F 9/26 |

* cited by examiner

GAME SYSTEM AND PIECES

This application claims priority to U.S. provisional patent application having Ser. No. 63/766,151 filed on Mar. 3, 2025. This and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The present invention relates to dexterity game systems and methods of play, especially as it relates to balancing games involving the strategic placement of objects on a dynamically tilting platform.

BACKGROUND OF THE INVENTION

The background description includes information that may be useful in understanding the present invention. It is not an admission that any of the information provided herein is prior art or relevant to the presently claimed invention, or that any publication specifically or implicitly referenced is prior art.

All publications and patent applications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Dexterity games have long been popular as amusement devices. Traditional examples include stacking games like Jenga®, where blocks are removed or added to a tower, or Kerplunk!®, where sticks are pulled from a tube to avoid dropping marbles. Such games test players' physical skills such as hand-eye coordination, balance, and fine motor control. However, many existing dexterity games suffer from limitations in design and functionality.

Conventional dexterity game systems often overlook portability, relying on separate containers or loose components that are susceptible to loss or damage during transport. Additionally, these systems frequently incorporate materials that add excessive weight, further impeding portability and user convenience.

Although various game systems and methods of play are known in the art, all or almost all of them suffer from one or more disadvantages, particularly with respect to the storage and portability of game components. Accordingly, there remains a need for a lightweight, self-contained, and compact game system.

SUMMARY OF THE INVENTION

The inventive subject matter is directed to systems and methods for a lightweight, self-contained, and compact balancing game.

In one aspect of the inventive subject matter, a game system can include a plurality of spheres (e.g., marbles) and a body consisting of a base having a planar top surface and a hemispherical bottom surface opposite the planar top surface. In preferred embodiments, the planar top surface has a plurality of indentations or apertures that are sized and dimensioned to receive a portion of one of the plurality of spheres. Furthermore, it is generally contemplated that the hemispherical bottom surface is configured to enable the base to tilt in response to an off-center weight distribution on the planar top surface relative to a center of the base, as a result of the placement of spheres on the top surface. In other words, the base generally is balanced when placed by itself on a flat surface but can become unbalanced as its weight distribution becomes off-centered.

In some embodiments, each of the plurality of indentations or apertures is concave to cradle a respective one of the plurality of spheres, and the indentations or apertures may be arranged in a grid pattern on the planar top surface. Additionally, the spacing between adjacent indentations or apertures is configured to allow stacking of the plurality of spheres on top of one another while maintaining the tilting instability of the base. Moreover, it is generally contemplated that the planar top surface may be circular in shape, although other shapes are contemplated.

Generally, the plurality of spheres, which may consist of at least 20 spheres, and perhaps more than 50 spheres, are marbles. Furthermore, the base is typically composed of injection-molded plastic. The number of spheres will likely depend on the size of the base and the desired length of play. While spheres are described herein, it is contemplated that the pieces may not be fully spherical, while still achieving the same effect. For example, while less preferred, the pieces could be hemispheres (half-spheres), for example. Other shapes could include, for example, ovoids, prolate spheroids, oblate spheroids, dodecahedrons.

It is also generally contemplated that the body is hollow and configured to store the plurality of spheres internally when not in use. To access the interior storage space for the plurality of spheres, the planar top surface may be removable from the base. In some embodiments, the base includes a peripheral wall having a raised lip or textured edge configured to facilitate removal of the planar top surface of the base.

In preferred embodiments, the hemispherical bottom surface is rounded and smooth to enable dynamic equilibrium on a flat surface. Typically, the planar top surface and the hemispherical bottom surface comprise interlocking parts. In various embodiments, the game system may further comprise at least one extension, arm, or protrusion emanating from the base to modify balancing characteristics.

In another aspect of the inventive subject matter, the inventor contemplates a method of playing a game using the above-described game system that involves steps of instructing the plurality of spheres to be divided among a plurality of players, instructing each player, in turn, to place at least one sphere on the planar top surface of the base, and determining an outcome based on whether the base tilts due to an off-center weight distribution, causing one or more spheres to fall from the base.

Most typically, the outcome includes at least one of continuing play, penalizing the player who placed the at least one sphere, eliminating the player, or ending the game.

Viewed from another perspective, the inventor additionally contemplates a structure for a balancing game that consists of a planar top surface comprising a plurality of indentations or apertures each sized to receive a sphere and a hemispherical bottom surface opposite the planar top surface, configured to enable multi-directional tilting of the structure in response to an off-center weight distribution on the planar top surface.

The structure is generally contemplated to have an interior cavity to store a plurality of spheres. In addition, the plurality of indentations or apertures are arranged in a pattern that allows for stacking of spheres while maintaining the multi-directional tilting instability of the structure.

Various objects, features, aspects, and advantages of the inventive subject matter will become more apparent from the following detailed description of preferred embodiments, along with the accompanying drawing figures in which like numerals represent like components.

DETAILED DESCRIPTION

The present invention provides a dexterity game system and method of play directed to a lightweight, self-contained, compact balancing game.

Figure 1:
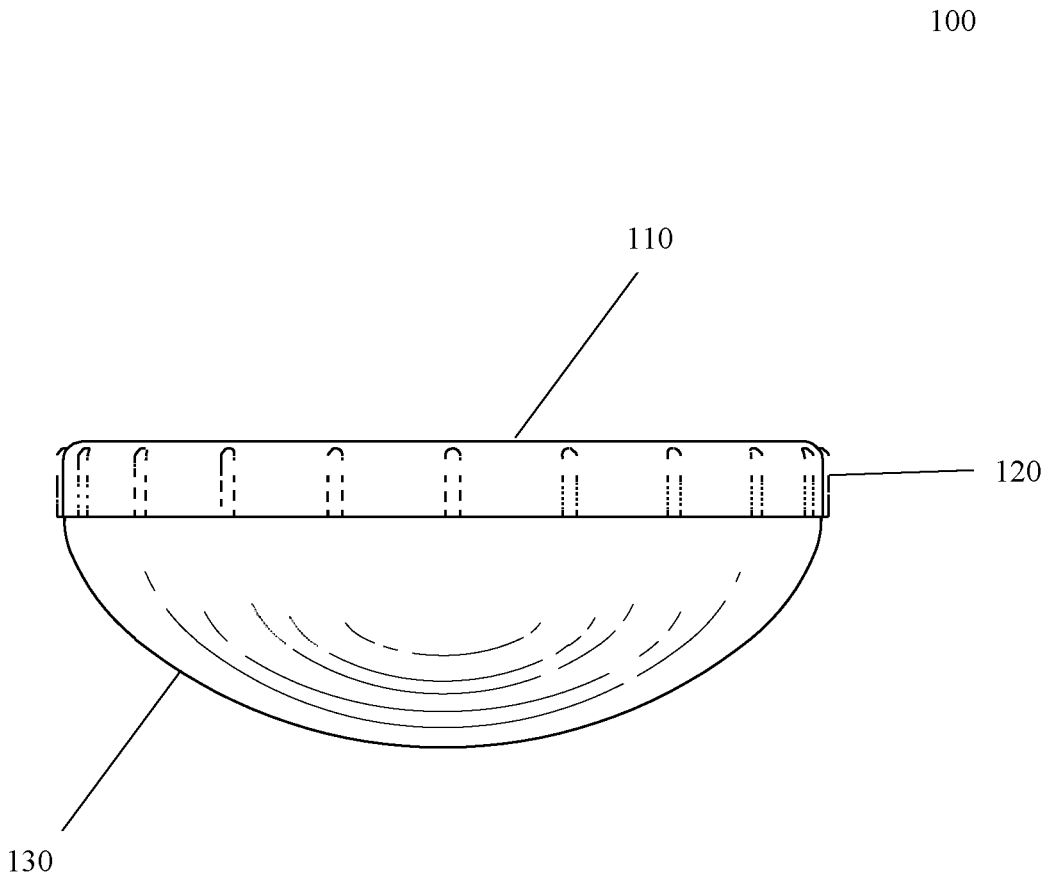
FIG. 1 is an exemplary schematic illustrating a front view of an embodiment of a base for the game.
Figure 2:
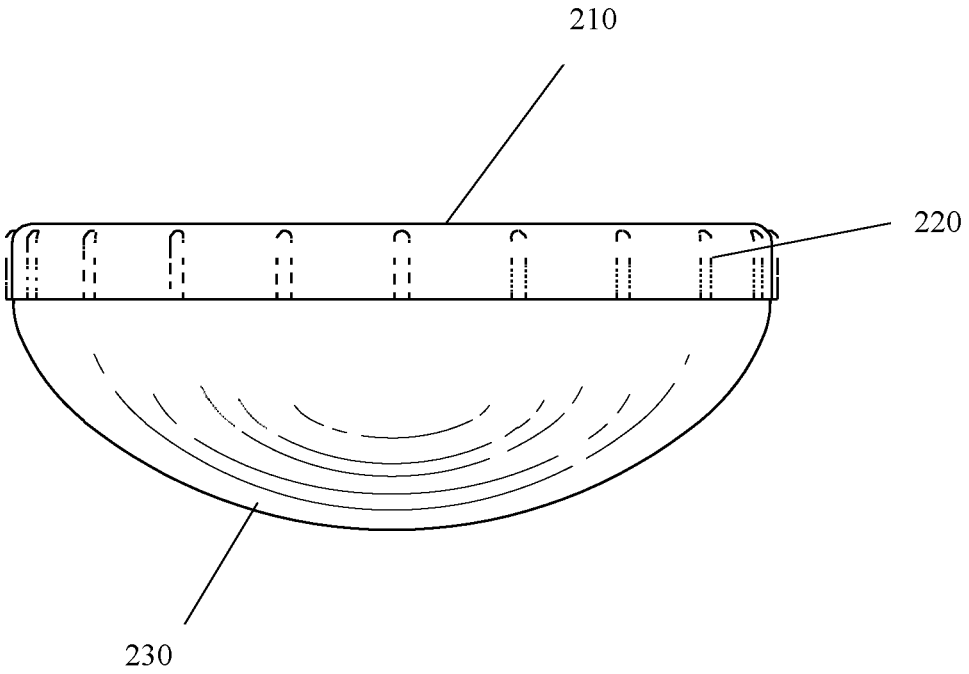
FIG. 2 is an exemplary schematic illustrating a right-side view of an embodiment of a base for the game.
Figure 3:
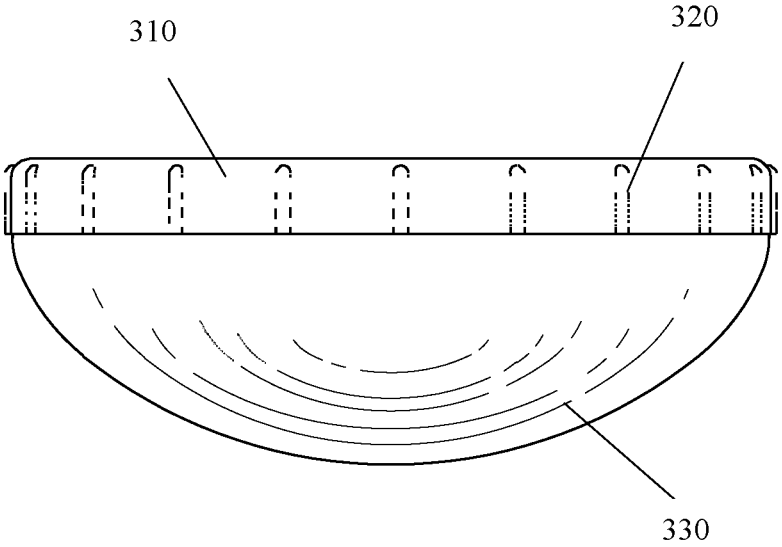
FIG. 3 is an exemplary schematic illustrating a left side view of an embodiment of a base for the game.
Figure 6:
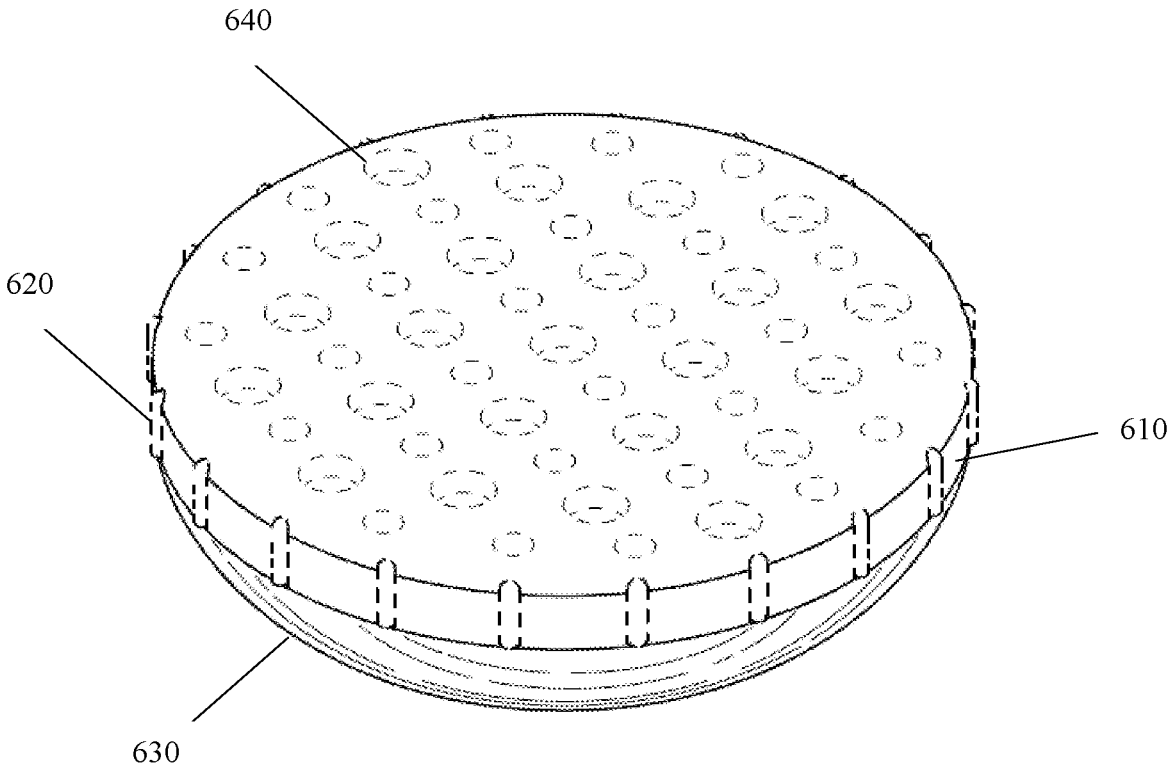
FIG. 6 is an exemplary schematic illustrating an isometric view of an embodiment of a base for the game.
Figure 7:
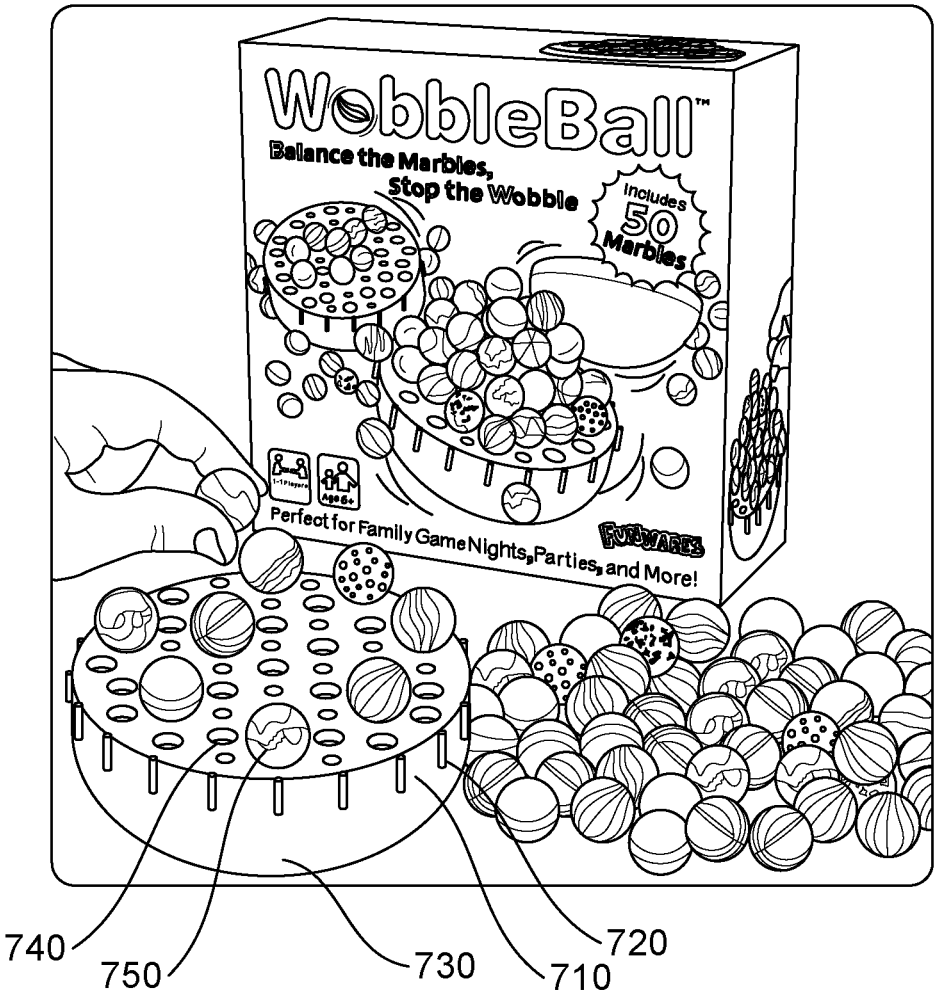
FIG. 7 is an exemplary schematic illustrating an exemplary embodiment of the game and corresponding packaging.

As shown in FIG. 7, the game system typically includes a plurality of spheres 750 (game pieces) and a body 100, as shown in FIG. 1, comprising a base having a planar top surface 710 (corresponding to 110 in FIG. 1, 210 in FIG. 2, 310 in FIG. 3, 410 in FIG. 4, and 610 in FIG. 6) and a hemispherical bottom surface 730 (corresponding to 130 of FIG. 1, 230 in FIG. 2, 330 in FIG. 3, 530 in FIG. 5, and 630 in FIG. 6) opposite the planar top surface 710. Preferably, the game system further includes a set of instructions outlining the rules of play. In one exemplary method of play, players first divide the plurality of spheres 750 among themselves. The spheres are typically marbles but may alternatively be formed of other materials such as wood, metal, or plastic. It is generally contemplated that a game set includes 50 spheres. However, embodiments may vary to include fewer or more spheres. For example, a mini game set may include 25 spheres and an extra-large game set may include 100 spheres. Additionally, the number of spheres in a game set may range from at least 20, at least 40, at least 60, at least 80, at least 100, at least 150, or at least 200 depending on the size of the base.

As discussed above, while spheres are described, it is contemplated that the pieces may not be fully spherical, while still achieving the same effect. For example, while less preferred, the pieces could be hemispheres (half-spheres), for example. Other shapes could include, for example, ovoids, prolate spheroids, oblate spheroids, dodecahedrons.

Regardless of the number of spheres, each player is instructed, in turn, to place or stack a sphere on the planar top surface 710, which features a plurality of indentations or apertures 740 (corresponding to 640 in FIGS. 6 and 440 in FIG. 4) sized and dimensioned to receive the spheres. In addition, the hemispherical bottom surface enables the base to tilt multi-directionally in response to an off-center weight distribution relative to the base's center. Consequently, suboptimal sphere placement can induce tilting, thereby testing players' precision and nerve. If the placement creates excessive unbalance, the base will tilt toward the extra weight, potentially dislodging spheres and eliminating the responsible player. In severe instances, the base may fully topple, displacing all spheres and ending the game.

Figure 4:
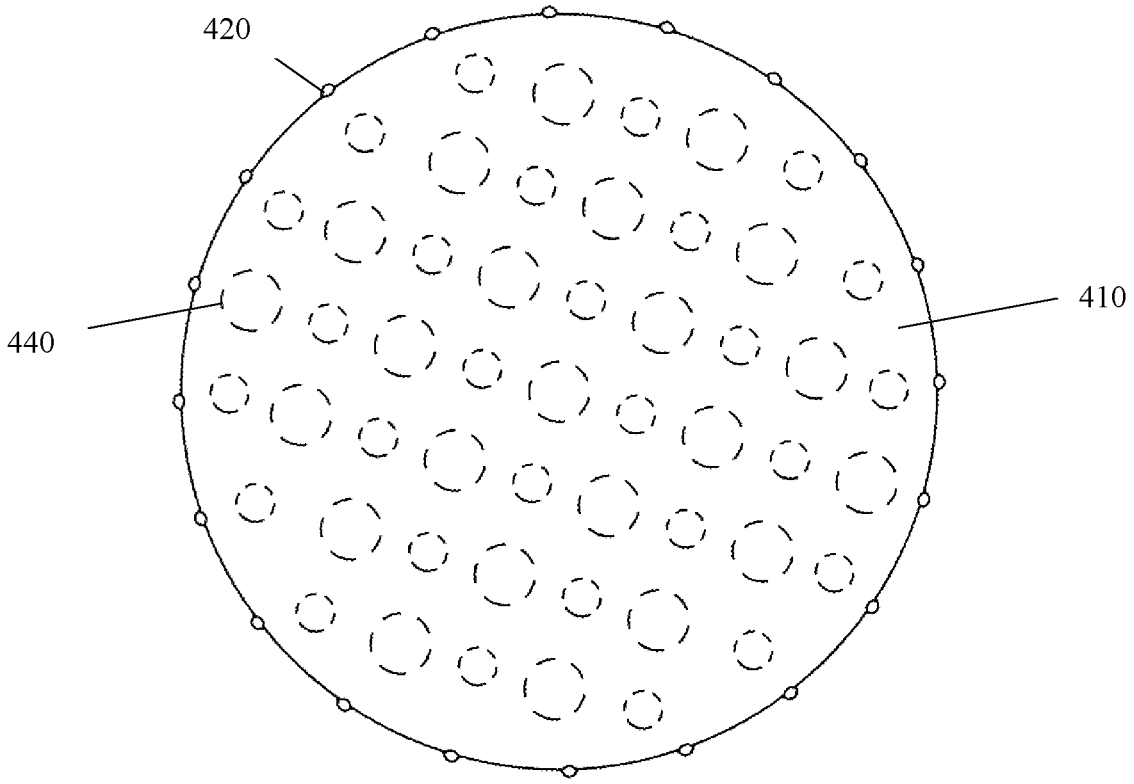
FIG. 4 is an exemplary schematic illustrating a top view of an embodiment of a base for the game.

As illustrated in FIG. 4, the planar top surface 410 of the base features a grid or set of recessed cavities or holes 440 (corresponding to 640 of FIG. 6 and 740 of FIG. 7), systematically arranged to receive individual spheres. Each cavity is slightly concave to cradle a sphere while permitting subtle movement and shifting as additional spheres are added. In some embodiments, the indentations or apertures are arranged in a grid pattern. While in other embodiments, the indentations or apertures may follow a spiral, circular, or diamond configuration. Moreover, the planar top surface is typically circular in shape, which may limit the possible configurations that the indentations or apertures may follow. Regardless of the cavity arrangement, the spacing between them is optimized to allow close stacking of the spheres without immediately stabilizing the structure, thus preserving the base's tilting instability and the balancing challenge.

As will be readily appreciated, the depth of the concavities may vary across different embodiments of the game, but it is generally contemplated that each concavity has depth and width dimensions sufficient to cradle the corresponding spheres provided in the game set. For example, smaller game sets, may employ smaller spheres, requiring that the indentations or apertures are sized accordingly. The spheres may have a diameter of at least 10 mm, at least 12 mm, at least 14 mm, at least 16 mm, or at least 25 mm. Correspondingly, the concavities on the planar top surface may have a corresponding width of at least 10 mm, at least 12 mm, at least 14 mm, at least 16 mm, or at least 25 mm, to cradle (or hold) spheres that are placed into the indentations or apertures. Similarly, the depth of the indentation or apertures may range from 2.5 to 5 mm, from 3 to 6 mm, from 3.5 to 7 mm, from 4 to 8 mm, or from 6 to 12.5 mm, such that when a sphere is placed in an indentation or aperture, at least half of the sphere protrudes outside the cradle of the indentation or aperture.

Figure 5:
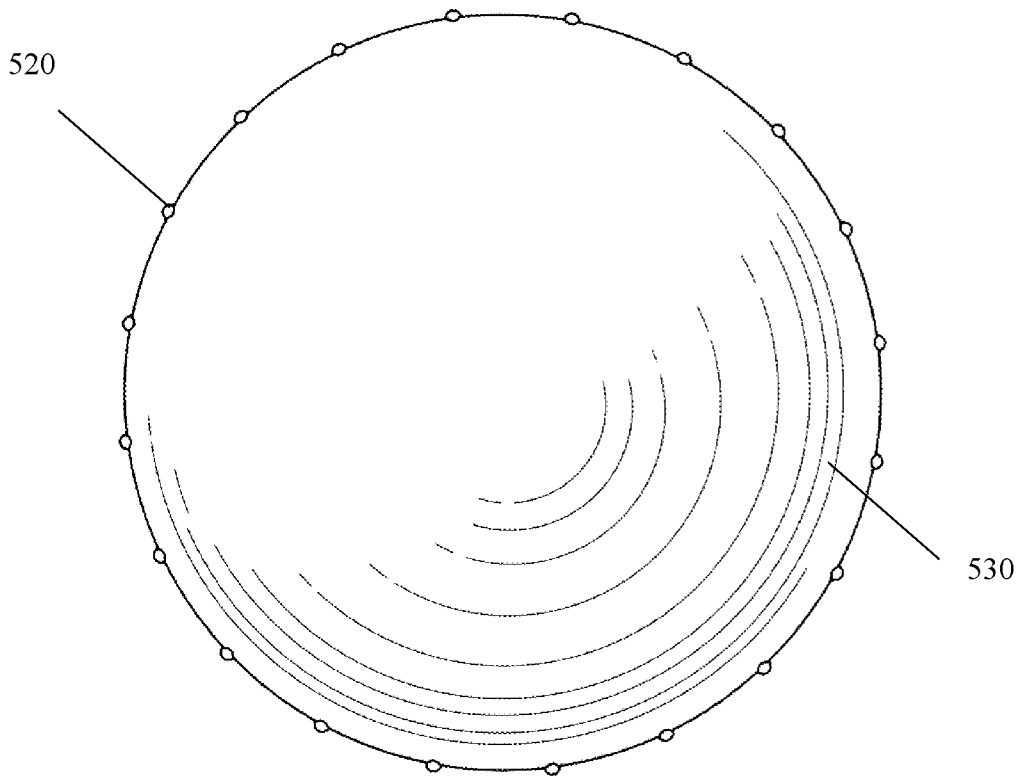
FIG. 5 is an exemplary schematic illustrating a bottom view of an embodiment of a base for the game.

Regarding the body, it may be hollow and configured to provide controlled instability when placed on a flat surface, such as a table or floor. As shown in FIG. 5, the hemispherical bottom surface 530 forms a rounded and smooth hemispherical shell that enables dynamic equilibrium on the flat surface, shifting in response to any applied force or imbalance created by the placement of spheres on the planar top surface.

Due to the hollow construction of the body, the plurality of spheres can be stored internally when not in use. The planar top surface may be removeable from the base to access this interior storage space. As shown in FIGS. 1-7, the base's peripheral wall includes a raised lip or textured edge 120 (corresponding to 220 in FIG. 2, 320 in FIG. 3, 420 in FIG. 4, 520 in FIG. 5, 620 in FIG. 6, and 720 in FIG. 7) to facilitate removal of the planar top surface 110. This feature provides a convenient, integrated storage solution, ensuring that all game components remain together and easily transportable.

To maintain a sealed state for housing the plurality of spheres and/or for gameplay, it is preferable that the planar top surface and the hemispherical bottom surface form at least two interlocking parts or a single-molded unit with an access panel on the side of the body to access the internal storage space of the body. The planar top surface may connect to the hemispherical bottom surface via a screw mechanism, snap-fit, tongue-and-groove, or magnetic attachment.

Furthermore, alternative structural configurations of the base are envisioned, including extensions, arms, or other protrusions emanating from the hemispherical shell to increase the complexity of the game. Such modifications may introduce additional balancing challenges, requiring players to adjust their sphere placement strategies based on varying base designs.

The structural integrity of the base is upheld through the use of durable, lightweight materials such as injection-molded plastic, ensuring both longevity and the fluid movement essential for gameplay. Contemplated materials that are lightweight and durable include acrylonitrile butadiene styrene (ABS), polypropylene (PP), polycarbonate (PC), polyamide (nylon), or 3D-printable polymers like polylactic acid (PLA).

This unique combination of a hemispherical, tilting base featuring strategically positioned spherical slots on a planar top surface, along with potential structural variations, delivers an engaging and unpredictable gameplay experience that distinguishes it from other balancing games. These design elements heighten the precision, skill, and challenge involved in stacking spheres while preserving a simple, intuitive, and repeatable setup suitable for users of all ages.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A game system, comprising:

a plurality of spheres;

a body comprising a hemispherical-shaped housing that is removably coupled with a lid having a planar top surface, wherein the hemispherical-shaped housing comprises an opening at one end and a curved bottom surface opposite the opening;

wherein the planar top surface is removably attached to the hemispherical shaped housing, and wherein the lid and housing together define an interior storage space configured to store the plurality of spheres when not in use;

wherein the planar top surface of the lid comprises a plurality of indentations or apertures, each of which is sized and dimensioned to receive a portion of one of the plurality of spheres and configured to maintain a position of the received sphere on the planar top surface within the indentation or aperture to prevent movement of the received sphere and such that at least half of the received sphere protrudes outside the indentation or aperture when received therein;

wherein the curved bottom surface enables the body to tilt in response to an off-center weight distribution on the planar top surface of the lid relative to a center of the body.

2. The game system of claim 1, wherein each of the indentations or apertures is concave to cradle one of the plurality of spheres.

3. The game system of claim 1, wherein the plurality of indentations or apertures is arranged in a grid pattern on the planar top surface.

4. The game system of claim 1, wherein spacing between adjacent indentations or apertures is configured to allow stacking of the plurality of spheres on top of one another while maintaining the tilting instability of the body.

5. The game system of claim 1, wherein the plurality of spheres are marbles.

6. The game system of claim 1, wherein the planar top surface of the lid and the body form a hemisphere when the top surface is attached to the body the base.

7. The game system of claim 1, wherein the body includes a peripheral wall having a raised lip or textured edge configured to facilitate removal of the planar top surface of the base.

8. The game system of claim 1, wherein the hemispherical bottom surface is rounded and smooth to enable dynamic equilibrium of the body on a flat surface.

9. The game system of claim 1, wherein the body is composed of injection-molded plastic.

10. The game system of claim 1, wherein the lid and the body comprise interlocking parts.

11. The game system of claim 1, wherein the plurality of spheres comprises at least 50 spheres, and wherein the interior storage space is configured to hold the at least 50 spheres.

12. The game system of claim 1, wherein the planar top surface is circular in shape.

13. A structure for a balancing game, comprising:

a planar top surface comprising a plurality of indentations or apertures each sized to receive a portion of a game piece and configured to maintain a position of the received sphere within the indentation or aperture on the planar top surface such that at least half of each sphere protrudes outside the indentation or aperture when received therein, and wherein the game piece comprises a marble or sphere;

wherein the planar top surface is removably attached to a housing having a hemispherical shape, and wherein the housing comprises an interior storage space, and wherein the planar top surface is detachable from the housing to access the interior storage space that is configured to store a plurality of spherical game pieces; and the body comprising a curved bottom surface of the hemisphere that is opposite the planar top surface, wherein the curved bottom surface enables multi-directional tilting of the structure in response to an off-center weight distribution on the planar top surface due to the game pieces placed thereon.

14. The structure of claim 13, wherein the plurality of indentations or apertures are arranged in a pattern that allows for stacking of game pieces while maintaining the multi-directional tilting instability of the structure.

* * * * *